US008677792B2

(12) United States Patent
Wheeler

(10) Patent No.: US 8,677,792 B2
(45) Date of Patent: Mar. 25, 2014

(54) ELECTRONIC DOOR LOCK APPARATUS

(75) Inventor: Thomas J. Wheeler, Pomona, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 288 days.

(21) Appl. No.: 12/658,425

(22) Filed: Feb. 10, 2010

(65) Prior Publication Data

US 2010/0212373 A1 Aug. 26, 2010

Related U.S. Application Data

(60) Provisional application No. 61/208,680, filed on Feb. 25, 2009.

(51) Int. Cl.
*E05B 13/00* (2006.01)

(52) U.S. Cl.
USPC ..... 70/472; 70/218; 70/223; 70/278.7; 70/279.1

(58) Field of Classification Search
USPC ..... 70/223, 277, 278.7, 279.1, 422, 70/367–371, 451, 472, 149, 188, 189, 218, 70/432, 232, DIG. 57, 276, 466; 292/DIG. 27
See application file for complete search history.

(56) References Cited

U.S. PATENT DOCUMENTS

| | | | | | |
|---|---|---|---|---|---|
| 1,303,825 | A * | 5/1919 | Shaw | 70/370 |
| 1,512,939 | A * | 10/1924 | Ledin | 70/134 |
| 3,434,316 | A * | 3/1969 | Neary | 70/371 |
| 3,939,679 | A * | 2/1976 | Barker et al. | 70/277 |
| 4,196,602 | A * | 4/1980 | Akselsen | 70/211 |
| 4,567,741 | A * | 2/1986 | Trempala | 70/389 |
| 4,671,087 | A * | 6/1987 | Olenfalk et al. | 70/283 |
| 4,762,212 | A * | 8/1988 | Fish et al. | 192/24 |
| 4,813,250 | A * | 3/1989 | Yeh | 70/104 |
| 4,854,143 | A * | 8/1989 | Corder et al. | 70/218 |
| 4,936,122 | A * | 6/1990 | Osada | 70/214 |
| 4,941,697 | A * | 7/1990 | Fan | 292/336.3 |
| 5,000,018 | A * | 3/1991 | Eisermann | 70/277 |
| 5,010,748 | A * | 4/1991 | Derman | 70/164 |
| 5,033,282 | A | 7/1991 | Gartner et al. | |
| 5,040,652 | A * | 8/1991 | Fish et al. | 70/189 |
| 5,220,816 | A * | 6/1993 | Fish et al. | 70/214 |
| 5,577,408 | A * | 11/1996 | Roos | 70/370 |
| 5,862,691 | A * | 1/1999 | Friedrich et al. | 70/264 |
| 5,890,384 | A * | 4/1999 | Bartel et al. | 70/264 |
| 6,012,310 | A * | 1/2000 | Hsiao | 70/278.2 |
| 6,527,314 | B2 * | 3/2003 | Brown | 292/336.3 |
| 7,007,526 | B2 * | 3/2006 | Frolov et al. | 70/277 |
| 7,475,577 | B2 * | 1/2009 | Taniguchi et al. | 70/186 |
| 7,591,158 | B2 * | 9/2009 | Konno et al. | 70/252 |
| 7,870,768 | B2 * | 1/2011 | Tanioka et al. | 70/186 |
| 2001/0005998 | A1 * | 7/2001 | Imedio Ocana | 70/277 |
| 2007/0209413 | A1 * | 9/2007 | Dobbs | 70/279.1 |
| 2009/0193859 | A1 * | 8/2009 | Kwon et al. | 70/91 |

FOREIGN PATENT DOCUMENTS

| | | |
|---|---|---|
| CA | 2565505 | 4/2007 |
| EP | 1803875 A2 | 4/2007 |

* cited by examiner

*Primary Examiner* — Lloyd Gall
(74) *Attorney, Agent, or Firm* — Woods Oviatt Gilman LLP

(57) ABSTRACT

Door lock apparatus, comprising in combination an elongated housing having input code selectors on the housing, to enable door locking and/or unlocking via a locking element, a locking handle protruding from the housing, a coupling in the housing having parts that interfit to enable force transmission between the handle and element, and a coupling mechanism responsive to code selection to control coupling of the parts.

15 Claims, 11 Drawing Sheets

FIG. 1.
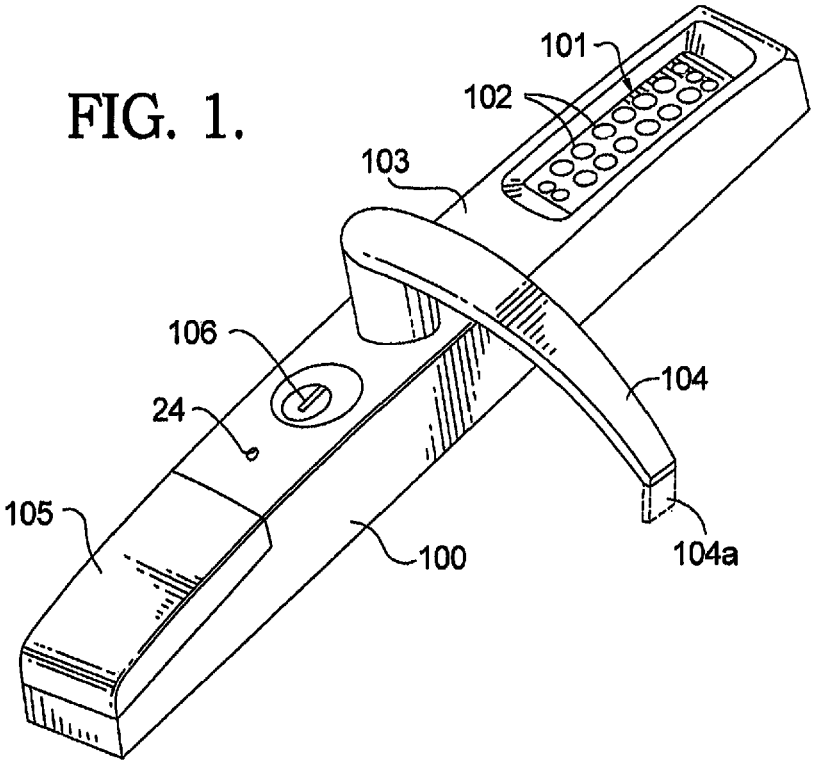
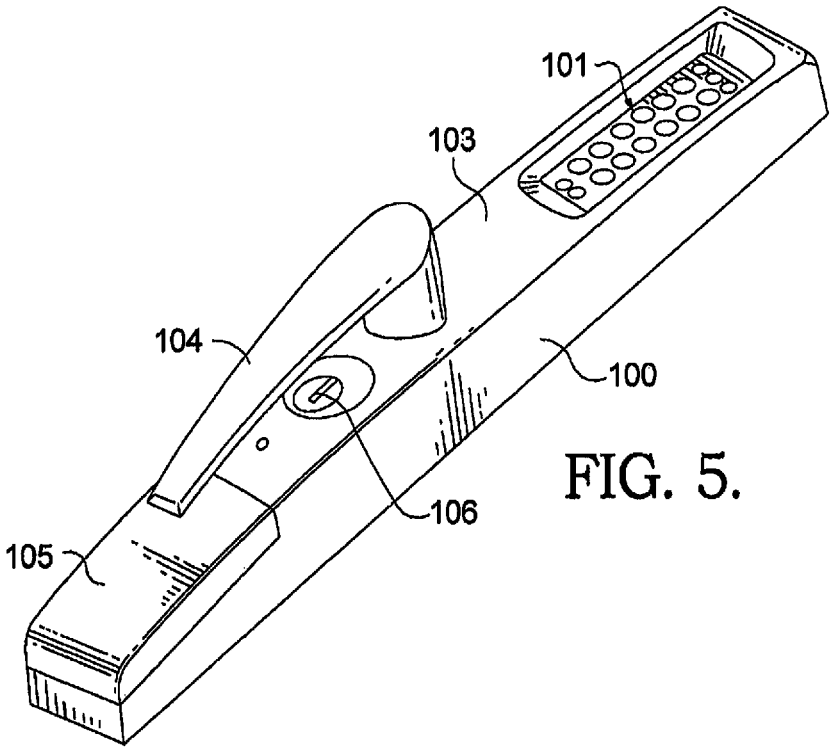
FIG. 5.

SYSTEM

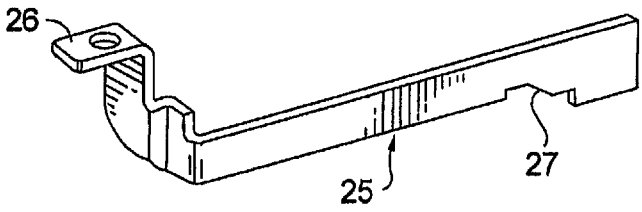
FIG. 13.
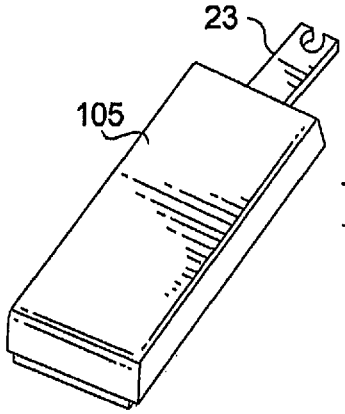
FIG. 14.
FIG. 15.
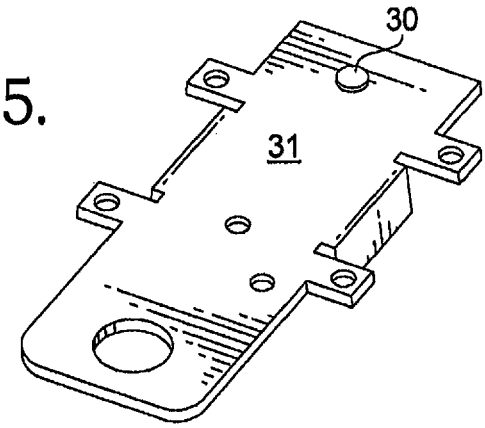

FIG. 16.
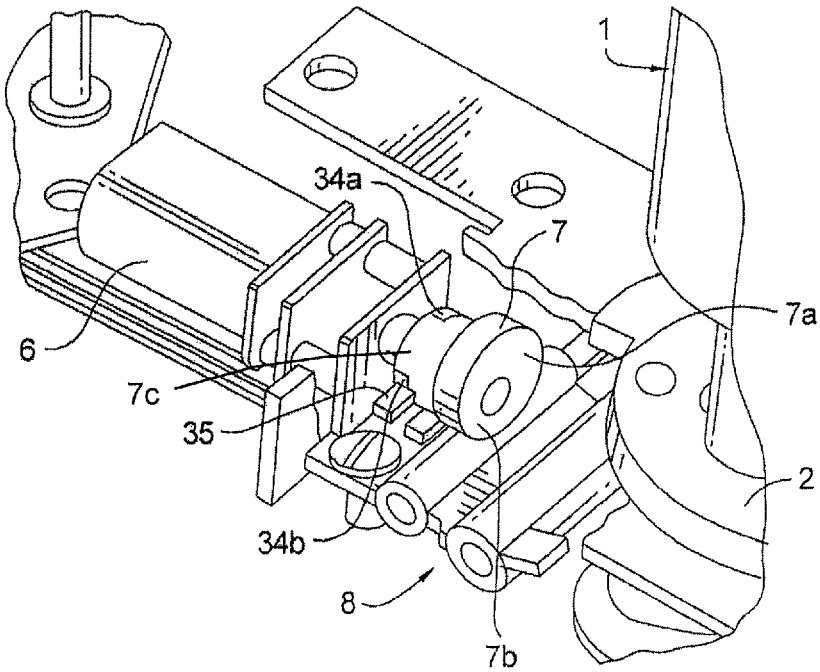
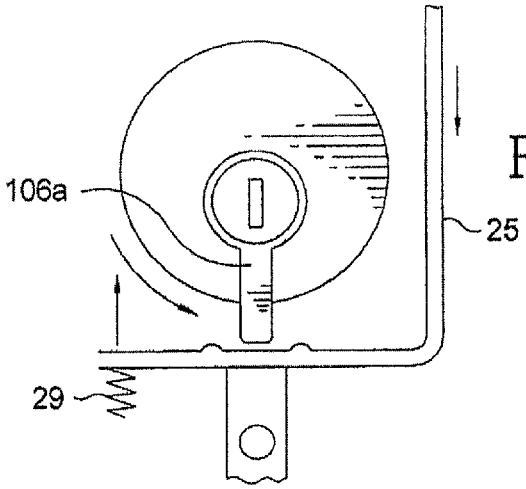
FIG. 17.

ELECTRONIC DOOR LOCK APPARATUS

CROSS-REFERENCE TO RELATED APPLICATIONS

This application claims the benefit of U.S. Patent Application No. 61/208,680, filed Feb. 25, 2009.

BACKGROUND OF THE INVENTION

This invention relates generally to electronically or electronically controlled locks, such as door locks. More particularly, it concerns improvements in control mechanisms located between handle input, and latch or bolt outputs of such devices.

There is need for simplicity, reliability, and effectiveness of such control mechanisms, including improvements in structure, functioning and results associated with operation of such mechanisms.

SUMMARY OF THE INVENTION

It is a major object of the invention to provide improvements meeting the above needs. Basically, the invention is embodied in the following, in combination:

a) an elongated housing having input code selectors on the housing, to enable the door locking and/or unlocking via a locking element, b) a locking handle protruding from the housing, c) a coupling in the housing having parts that interfit to enable force transmission between said handle and element, d) and first means responsive to code selection to control coupling of said parts.

As will be seen, said means include an electronic motor in the housing to effect controlled displacement of one or more of said parts.

Another object include provision of second means to compensate for interfit misalignment of said parts and to automatically overcome said misalignment.

That second means may advantageously include a spring or springs biasing at least one of said parts to interfit another of said parts in response to relative rotation of said parts.

Another object is to provide means to resist handle turning at selected handle turn angles, and also allow handle turning in response to override force transmitted via handle turning, for handle re-positioning relative to the housing.

A further object include provision of handle force resisting structure that includes a rotor, an elongated spring, and at least one set of interengaged balls that transmit spring force to the rotor with mechanical advantage.

Yet another object is to provide coupling parts, and a spring or springs biasing at least one of said parts to interfit another of said parts in response to relative rotation of said parts. One of such springs may be compliant fork-shaped leaf spring urging the coupling against tips of the pins.

A further object is to provide means to compensate and overcome misalignment of coupling pins and slots in a coupler.

An additional object is to provide means to allow release of a battery cover, including a one-piece elongated shifter basically movable in response to key input turning of a control rotor.

Also, the housing may include a battery compartment lid, there being a retention fastener, an override bracket blocking access to the fastener from the exterior, and having a position in which such access is unblocked, there being means blocking movement of the bracket to said position in response to unauthorized such access.

An additional object is to provide apparatus multiple improvements as disclosed herein.

These and other objects and advantages of the invention, as well as the details of an illustrative embodiment, will be more fully understood from the following specification and drawings, in which:

DRAWING DESCRIPTION

FIG. 1 is a perspective view of lock apparatus incorporating the invention;

FIG. 5 is a view like FIG. 1, but with the handle turned to show length direction, the same as housing length;

FIG. 13 is a perspective view of the override bracket;

FIG. 14 is a perspective view of the battery compartment cover plate;

FIG. 15 is a perspective view of a crank cover;

FIG. 16 shows Hall Effect mechanism; and

FIG. 17 is a schematic view of override bracket and key cylinder cam.

DETAILED DESCRIPTION

Figure 2:
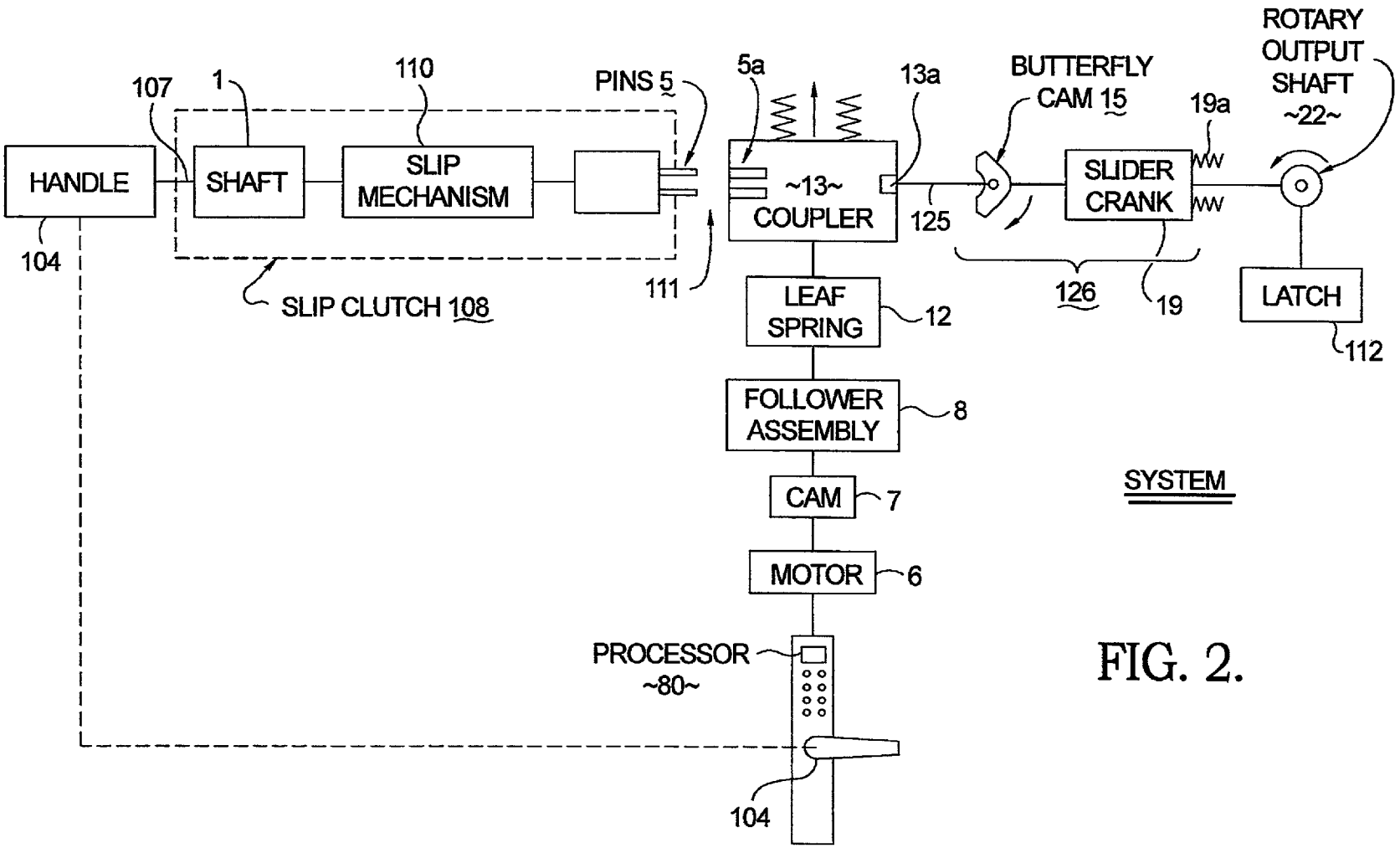
FIG. 2 is a diagram showing a system of elements carried within the apparatus housing, to effect operation of the lock in response to handle turning.

Referring first to FIGS. 1 and 5, it shows the lock assembly in the form of an elongated housing 100 with a key pad 101 including multiple coding selectors at 102 on the housing outer side 103. A handle 104 is carried for turning as between FIG. 1 and FIG. 5 positions. Batteries within the housing are accessible after removal of lid or cover plate 105, in response to insertion of a key into the housing via slot 106 and turning of the key, which permits the removal of the cover plate.

Figure 3:
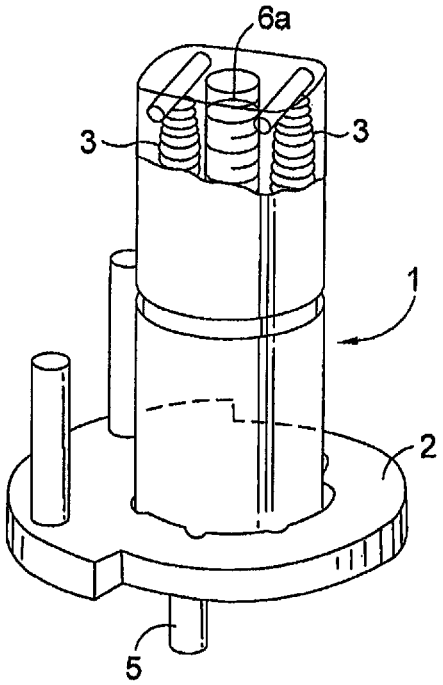
FIG. 3 is a perspective view of a handle re-positioning clutch mechanism.
Figure 4:
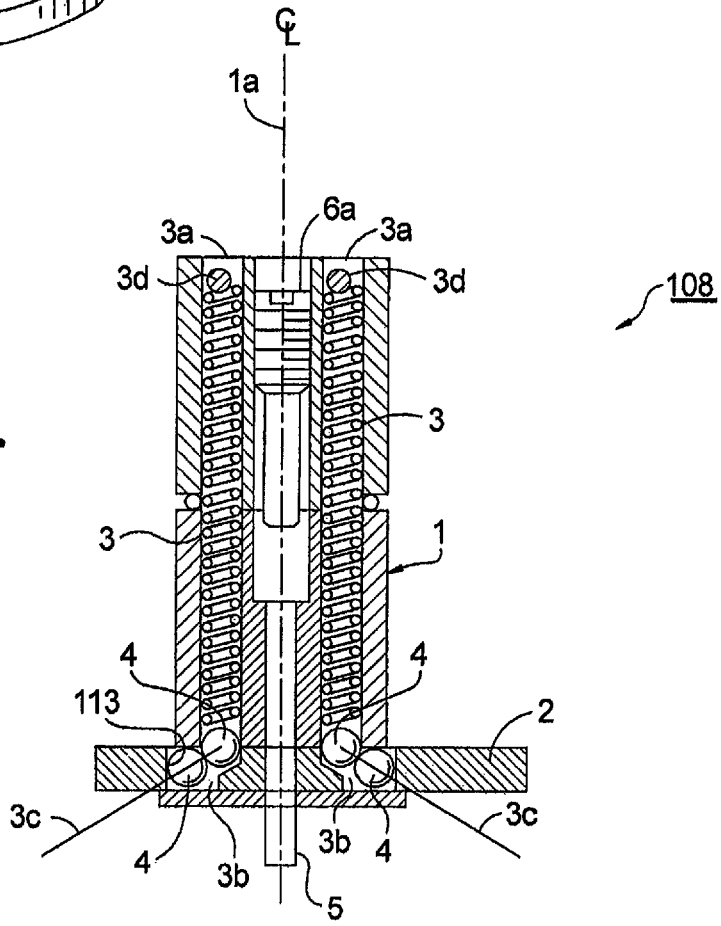
FIG. 4 is an axial section taken through FIG. 3.

Referring to the system schematic diagram seen in FIG. 2, it shows handle input displacement, such as turning, at 107, to a slip clutch assembly 108. The assembly shown includes a shaft 1, the slip-mechanism 110 allowing handle slip, and output pins 5. Referring to the FIGS. 3 and 4, slip clutch assembly 108 includes a clutch plate 2, two compression springs 3, four steel balls 4, two output pins 5, an override set screw 6*a*, and pins 3*d* securing springs 3 in vertical holes 3*a*. Handle 104 connects to the top of output shaft 1. A coupling mechanism 111 (see FIG. 2) couples the output pins 5 to the drive mechanism 126 that finally drives the deadbolt or dead latch device. A latch device is shown at 112 in FIG. 2. The slip clutch assembly 108 seen in FIG. 2 is designed to allow slippage of the handle 104 relative to the drive mechanism 126 at a torque lower than would be required to destroy or damage the drive mechanism but a torque significantly higher than normally required to operate a dead latch or deadbolt device through drive mechanism 126. In such capacity, the slip mechanism 110 acts as a mechanical "fuse" if for instance the deadbolt is "jammed" or misaligned with its mating strike plate. As shown in FIG. 4, the clutch plate 2 may have ball detent pockets 113 disposed radially every 45 degrees, about the axis of plate rotation. The output shaft 1 has a plurality (two, as shown) of vertical holes 3*a* drilled to house long compression springs 3. These holes are intersected by holes 3*b* at the bottom of the output shaft 1 radiating out from output shaft 1 centerline or axis 1*a*. The compression springs push downwards against steel balls oriented to push outwards against a second set of steel balls at a shallow pressure angle 3*c*. The second set of steel balls protrude out of the holes in the output shaft 1 and engage detent pockets 113 in the clutch plate 2. In this way, the orientation of the balls relative to their mating balls allow the springs to be located in perpendicular relation to the necessary direction of final force application for the clutch and situated in an orientation where more space is available. Note that the direction of spring elongation is parallel to the length direction of axis 1*a*. Furthermore, the shallow pressure angle 3*c* and friction between the ball pairs creates a mechanical advantage that allows a lower spring force to create a higher clutching torque. This allows the slip clutch assembly to be more compact and lower cost than would otherwise be feasible. FIG. 4 shows a section view of the slip clutch assembly 108.

Besides acting as a mechanical fuse, the slip clutch assembly 108 provides other benefits. For example, downward extending tail section 104*a* (FIGS. 1 and 11) may be added at the end of handle 104. With the battery cover plate 105 removed, clearance is provided between tail section 104*a* and housing 100 and the slip clutch assembly allows the handle to be rotated, past where the cover plate was, to a detent position 90 degrees from the normal operating position of the handle as shown in FIG. 5. This allows the unit to be shipped in a compact configuration with the handle already attached. This in turn minimizes packaging size/cost and freight charges. With cover plate 105 in place, tail extended section 104*a* prevents unwanted repositioning of handle 104.

Furthermore, the slip clutch assembly 108 allows the unit to be "rehanded" in the field, quickly and easily. For instance, some applications require the handle to point right and others require that it point left. When the unit is removed from packaging, the handle can be rotated two detent positions clockwise (45 degrees plus 45 degrees) if the handle needs to point left or two detent positions counter-clockwise (45 degrees plus 45 degrees) to point right. Thus, the unit can be "rehanded" any time in the field if there is a desire to remount the unit for re-handling.

In another aspect of the invention, a coupling mechanism is provided to couple the handle to drive mechanism 126, as via the slip clutch assembly 108. See for example in FIG. 2, coupler 13 receiving input via pins 5 of the slip clutch assembly 108, and transmitting rotary drive at 125 to drive mechanism 126. Such mechanism effects such coupling in response to operation of an electrical motor 6 controlled by the selectors 102 of the keypad 101. In this regard, means is provided to compensate for input misalignment of the coupling parts (typically pins 5 and slots 5*a* in coupler 13, such misalignment typically being rotary), and to automatically overcome such misalignment to enable effective coupling, for operation of the latch device 112 by the handle.

Figure 6:
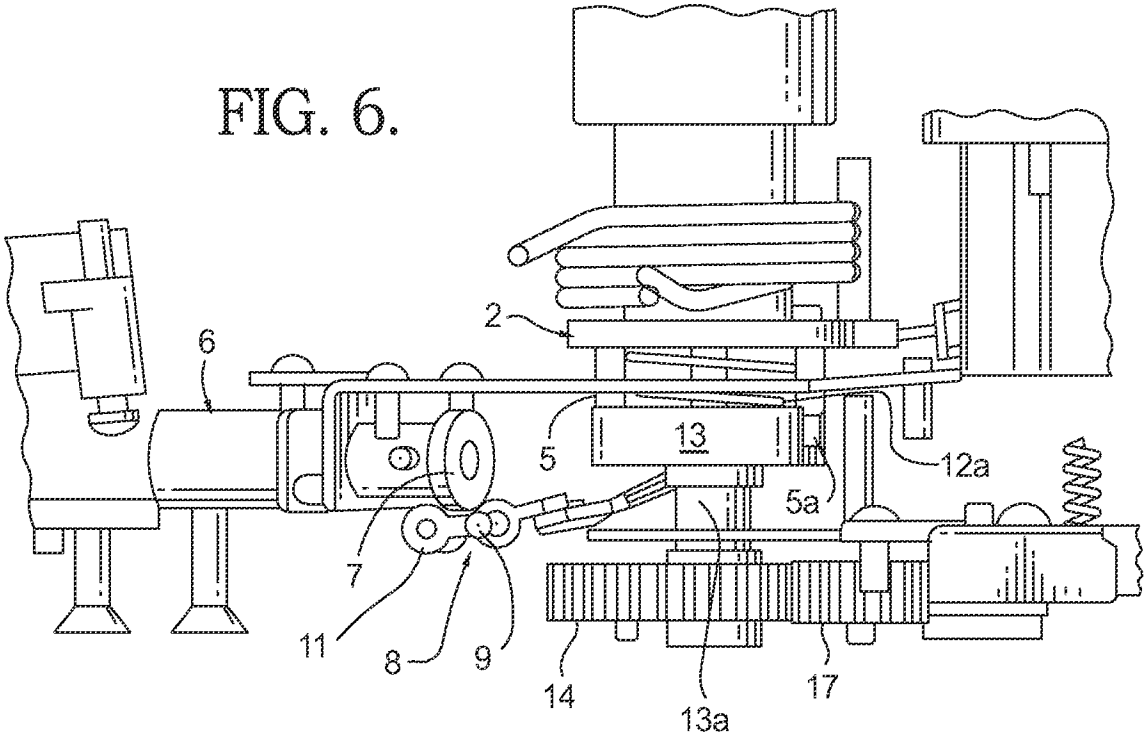
FIGS. 6-8 show coupling mechanisms.
Figure 7:
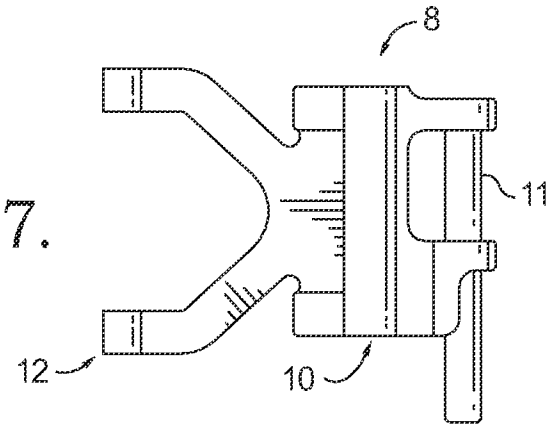
Figure 8:
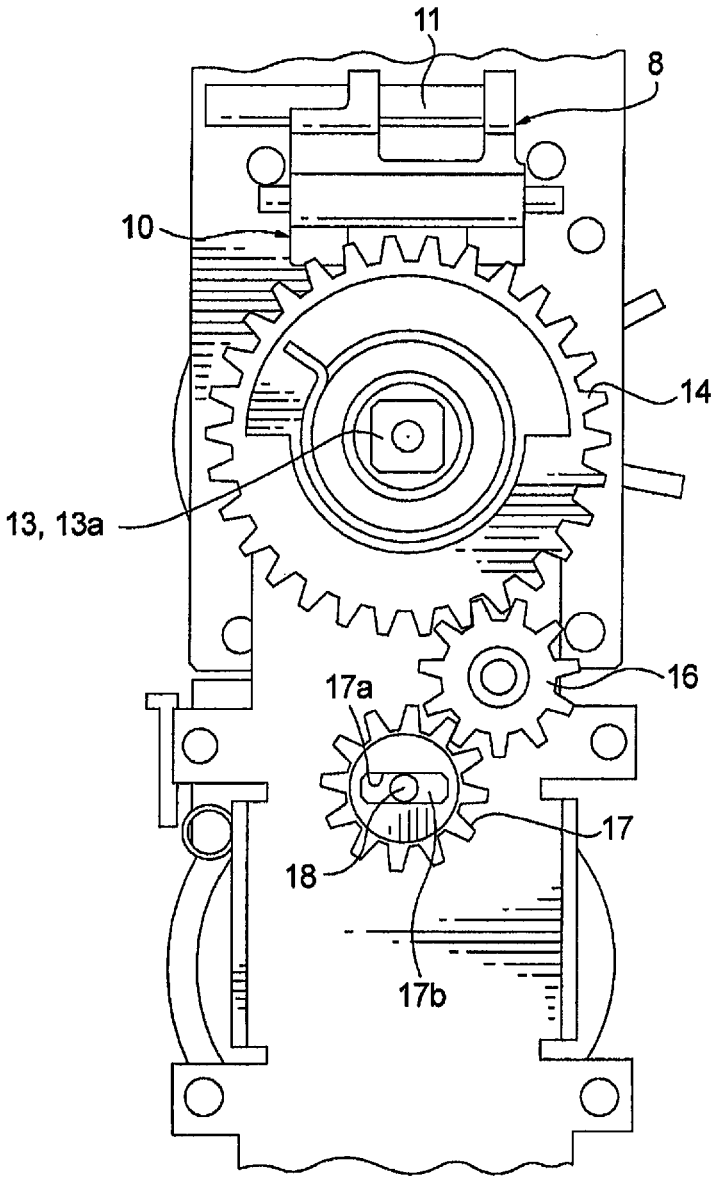

As shown in FIGS. 6-8, a keypad operated gear motor 32 drives a cam 7 that pushes on a cam follower assembly 8. The cam follower assembly 8 pivots around a mounting pin 9. The cam follower assembly 8 consists of a body 10, a cam follower pin 11, and a fork shaped leaf spring 12. Body 10 includes a first end and a second end, wherein cam follower pin 11 is disposed on the first end of body 10, and wherein fork shaped leaf spring 12 is disposed on the second end of body 10. The fork shaped leaf spring 12 pushes against a coupler 13 that is biased against the fork shaped leaf spring 12 with a light compression spring 12*a*. The spring constant and preload of the leaf spring 12 is significantly higher than that of the compression spring. Referring to FIGS. 6 and 16, when the high side lobe 7*a* of the cam 7 pushes down against the cam follower pin 11, the cam follower assembly 8 pivots around the pin 9. The fork shaped leaf spring 12 pushes against the coupler 13 causing it to move upwards until the output pins 5 engage slots 5*a* in the coupler 13. With the handle in its rest position 3 or 9 O'clock, the coupler pins 5 are aligned with slots 5*a* in the coupler 13 and the fork shaped leaf spring 12 only has to deflect a minute amount to compress the compression spring which biases the coupler 13 downwards (as oriented in FIG. 6). If for instance a user has the handle turned while operating the coupler and the coupler pins 5 do not align with the slots in the coupler 13, the fork shaped leaf spring 12 bends more and pushes the coupler 13 against the tips of the coupler pins 5. Once the handle has positioned to the 3 or 9 O'clock position (as in FIG. 1), the force from the fork shaped leaf spring 12 will push the coupler pins 5 into the coupler slots 5*a*. Thus, the fork shaped leaf spring 12 provides enough rigidity to overcome the compression spring but enough compliance so the mechanism does not lock up or stall with the handle moved out of a 3 or 9 O'clock position.

In the event that the unit's batteries die at a position where the lock is left in an unlocked position, the unit handle can be removed and the override set screw 6*a* tightened until the coupler 13 is no longer engaged to the coupler pins 5. Thus the unit is returned to a locked position. The compliance of the fork shaped leaf spring 12 allows this to happen without permanent damage to the unit. When the dead batteries are replaced the override set screw 6*a* can be backed off to allow normal operation.

Figure 9:
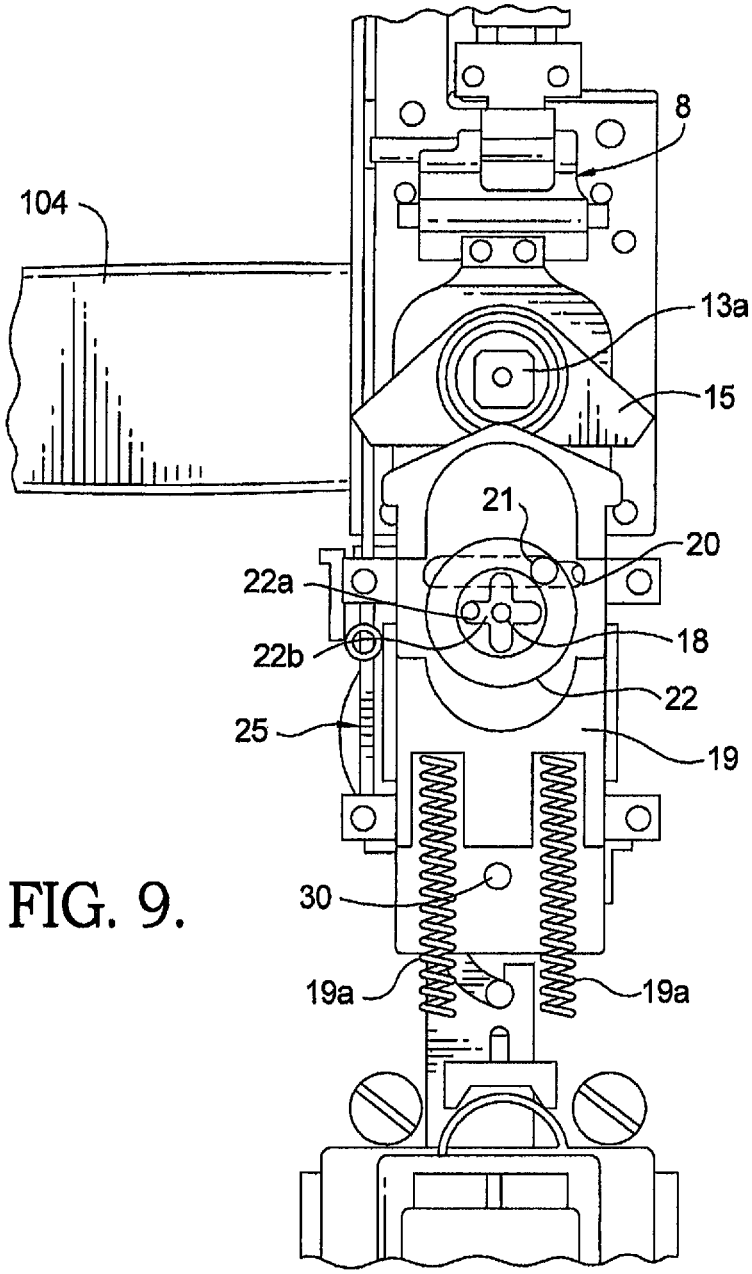
FIG. 9 shows a configuration of motion translation elements between the coupling and a dead latch.

Referring to FIGS. 6, 8 and 9, the coupler 13 slides axially on a square shaped shaft 13*a* that keys either to an input gear 14 or to a butterfly shaped cam 15 depending on whether the unit will operate a deadbolt or dead latch, respectively. The square feature of the shaft 13*a* allows coupler 13 to translate up and down, as oriented in FIG. 6, and also to transmit torque to shaft 13*a* through its entire range of motion.

The alternative deadbolt mechanism (FIG. 8) consists of three gears, an input gear 14, an idler gear 16, and an output gear 17. The output gear 17 has a rectangular opening 17*a* that accepts a sheet metal "tailpiece" 17*b*. The "tailpiece" couples the output gear 17 to the deadbolt device (not shown). A small magnet 18 holds the tailpiece in place while the unit is being assembled to the door.

Typically, deadbolts require two directions of output to operate the bolt. One direction of rotation of handle 104 locks the deadbolt while the opposite direction of rotation unlocks the deadbolt. The illustrated gear train mechanism in FIG. 8 provides two directions of output rotation for two directions of handle rotation.

In a dead latch application as shown in FIG. 9, the required direction can be clockwise or counterclockwise depending on whether door lock is right or left handed. Therefore, the dead latch version needs to be able to rotate in either direction, but only in one direction at a time.

Referring to FIG. 9, the butterfly shaped cam 15 keys to the coupler 13. The butterfly shaped cam 15 interacts with a slider crank 19. As oriented in FIG. 9, the slider crank is biased upward by two compression springs 19*a*. When the butterfly shaped cam 15 is coupled to the handle through the coupler 13, either direction of handle rotation causes the slider crank 19 to be moved downward due to the butterfly shaped cam 15 dual lobe symmetry. The slider crank 19 has an elongated slot 20 that receives a pin 21 from an output shaft 22. In FIG. 9, translation of the slider crank 19 in a downward direction causes clockwise rotation of the output shaft 22. The output shaft 22 couples to a dead latch through a tailpiece 22*b* inserted into its inner cross shape 22*a*. As with the dead bolt version, a small magnet 18 in the cross shape 22*a* helps hold the tailpiece in place during assembly. Furthermore, a user can insert a straight blade screwdriver into cross shape 22*a* and rotate output shaft 22 clockwise against the force of the two compression springs until the output shaft 22 goes "over center" and the pin 21 ends up on the opposite side of the slot 20 as shown in FIG. 10.

Figure 10:
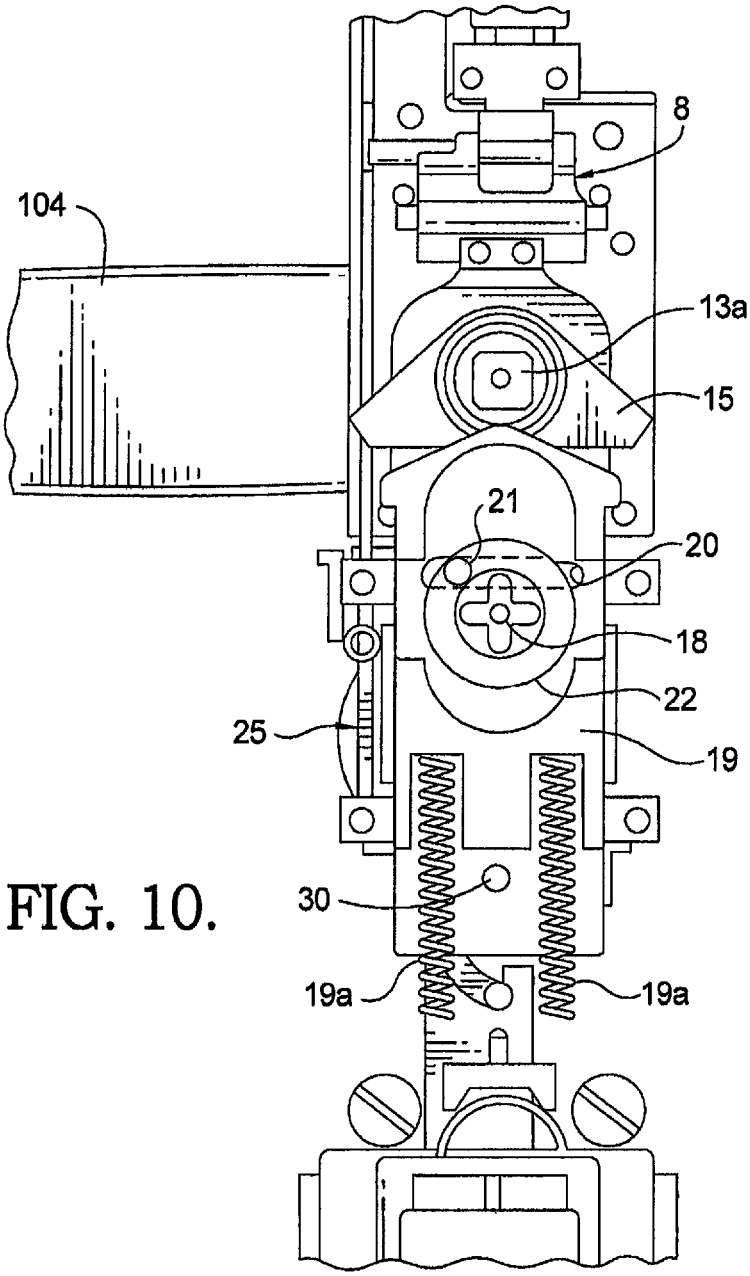
FIG. 10 is a view like FIG. 9, but showing shifted position of elements.

In this case, translation of the slider crank 19 downward in FIG. 10 causes counterclockwise rotation of the output shaft 22. In this way, the unit can be quickly and easily adjustably rehanded for right or left hand doors. This provides cost and logistics advantages to have one configuration work for either handling requirement.

As illustrated above, the deadbolt and dead latch versions share most parts and only differ in the last several parts in their respective mechanism chains. The relatively small differences are adapted to by the different output motion requirements. However, sharing of most components has a positive effect on keeping cost and complexity down.

Figure 12:
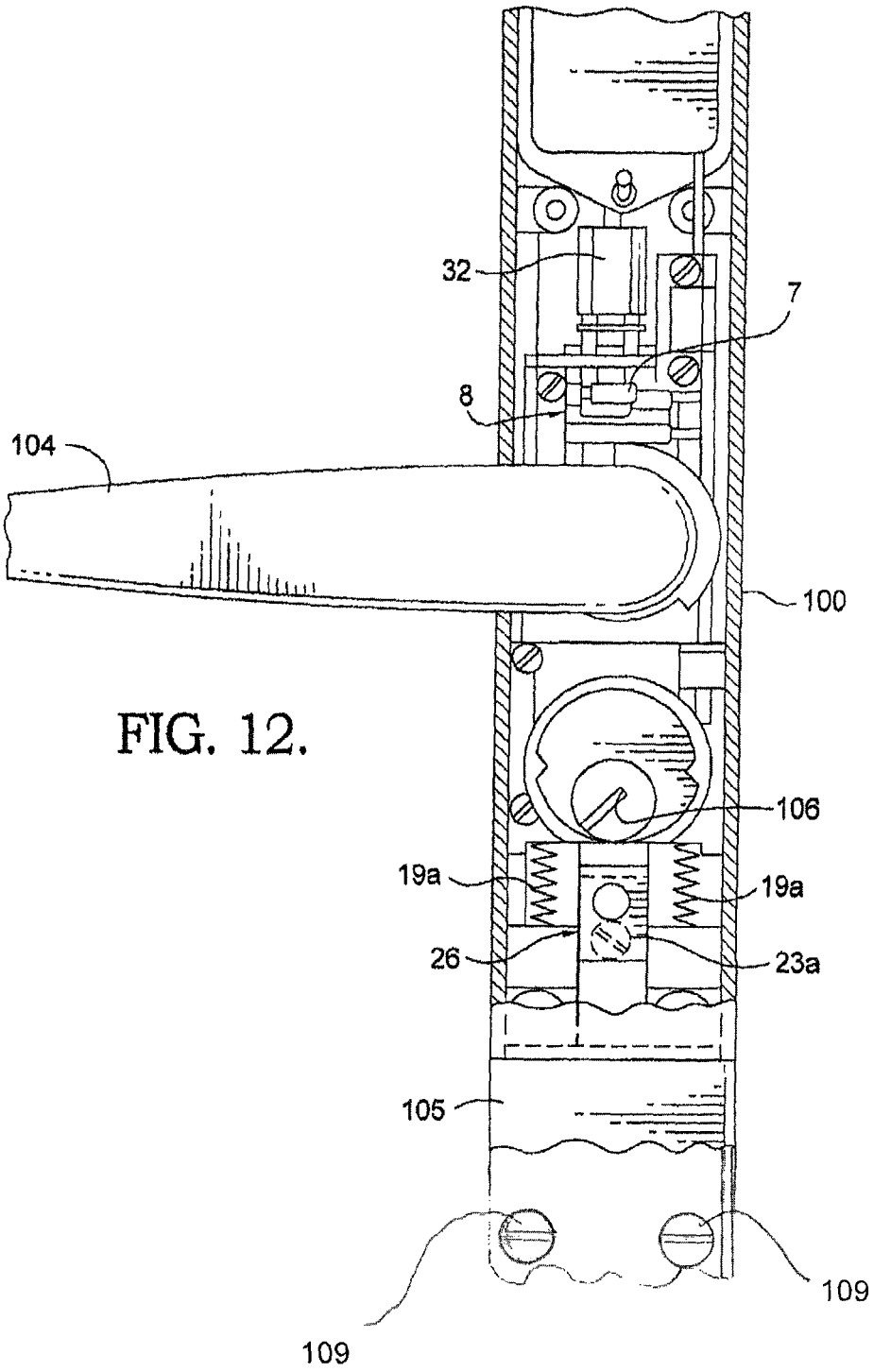
FIG. 12 is a frontal view of FIG. 11 elements showing the cover plate fastener blocked.

As with all locks, security is of utmost concern. The present device has a battery cover plate 105 (FIG. 1) that allows access to the battery compartment. With the batter cover plate off, this compartment also allows access to two mounting screws (109) at the bottom of elongate housing 100 (FIG. 12) for mounting the housing to a door. With these screws removed, the elongate housing can be unclipped from a hook (not shown) that holds the top of the housing to the door. By using such method of securing the unit to a door, all fasteners are hidden. For many architects, this is an important feature. It is therefore of importance that access to the housing mounting screws (109) that are accessible via the battery compartment be controlled to maintain security.

Figure 11:
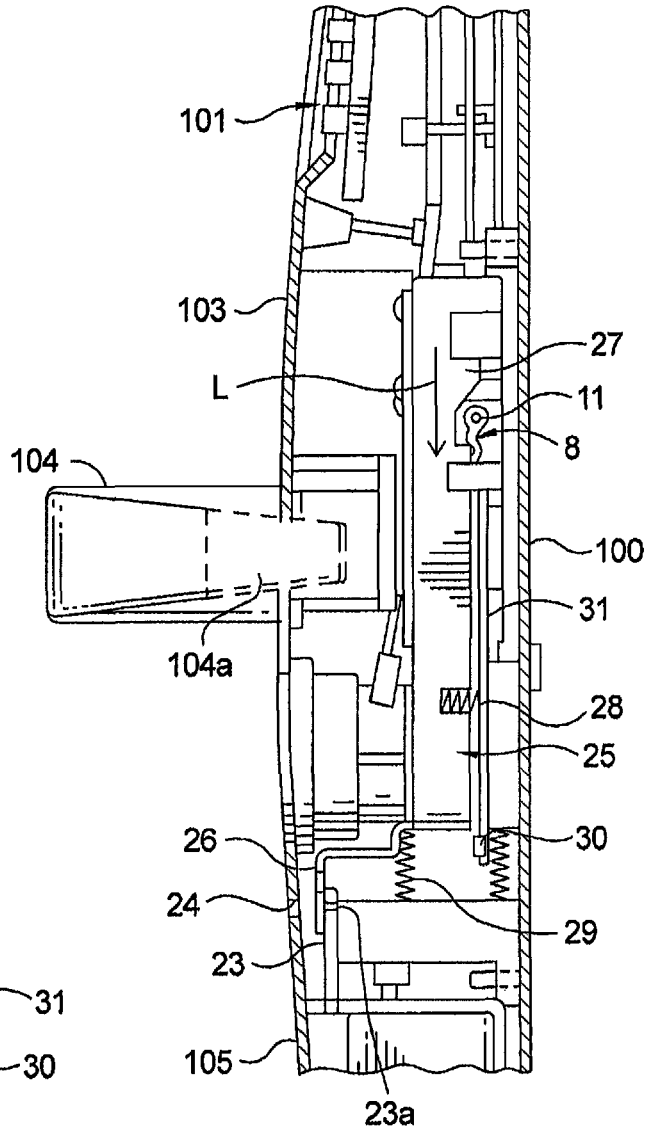
FIG. 11 is a side view showing installation of an override bracket for blocking access to a fastener that secures a battery compartment cover plate.
Figure 11A:
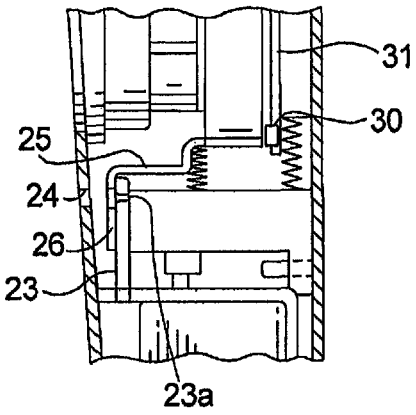
FIG. 11A is a side view of the mechanism shown in FIG. 11 with the cover plate fastener unblocked.

Referring to FIGS. 11 and 14, the battery cover plate 105 has a sheet metal tang 23 that is screwed to the elongate housing 100 by a screw 23*a* for securing the cover plate to the housing. Access to screw 23*a* is provided by a small hole 24 in the top of the housing. Referring to FIGS. 11 and 13, override bracket 25 has a feature 26 that blocks access to the battery cover plate screw 23*a* through this small hole 24. Referring to FIG. 1, the override bracket 25 interacts with a cam 106*a* of the key cylinder. Rotating the key to the unlocked position shown biases override bracket 25 downward against spring 29 and accomplishes two things: 1) a cam surface 27 on the back of the override bracket 25 pushes down on the cam follower pin 11 of the cam follower assembly 8 coupling the handle to output shaft 13*a*, and 2) the override bracket 25 moves downward (arrow L in FIG. 11) to a position where feature 26 no longer blocks the battery cover plate screw 23*a* and thus allows the battery cover plate to be removed (see FIG. 11A).

If a person were to insert a small sharp object such as a pick into hole 24, he might use two picks to try and "walk" the override bracket 25 down in small increments eventually allowing access to the battery lid screw and compromising security.

The override bracket 25 is normally biased upward towards the top and towards the front of the unit by two compression springs 29 and 28, respectively (FIG. 11). Referring to FIGS. 11 and 15, a small protruding feature 30 on crank cover 31 normally (such as when someone is using a key) does not interact with the override bracket 25. However, when someone necessarily pushes on the override bracket 25 against spring 28 through the cover plate access hole 24 to "pick" the unit, override bracket 25 moves away from the front of the unit slightly until its movement is blocked by protruding feature 30 on crank cover 31. This prevents to override bracket from being "walked" down to allow access to the batter cover plate screw.

Accordingly, the apparatus is configured to include a battery compartment cover plate having a retention fastener, an override bracket that blocks access to the fastener from the exterior and having a position in which such access is unblocked; and a means for blocking movement of the override bracket in response to unauthorized access.

Hall Effect cam position sensing is also provided. See FIG. 16. Gear motor 6 drives cam 7. The cam 7 has a "high" lobe 7*a* and a "low" lobe 7*b*. Upon rotation of the cam by motor 6, the high lobe pushes on cam follower assembly 8 as described above, which couples the handle to the output shaft. Upon further rotation of the cam by the motor, the cam "low" lobe 7*b* aligns with follower assembly 8. At that point, the handle becomes uncoupled to the output. It is therefore important to control the position of the cam 7 such that either the "high" or "low" lobe is aligned with cam follower assembly 8 when the motor stops. For this purpose, the cam 7 includes a body portion 7*c* that extends axially from lobes 7*a*, 7*b*, wherein the surface of body portion 7*c* houses south and north pole oriented magnets 34*a,b* that interact with a Hall Effect unit 35. The Hall Effect unit senses the magnetic flux of the magnets and "communicates" with microprocessor 80 such that the cam's position can be correctly detected.

The Hall Effect unit is powered via an I/O port of the microprocessor.

I claim:

1. A door lock apparatus, comprising in combination:

a) a housing, b) a handle protruding from the housing, c) a latch device disposed within the housing, the latch device configured for being positioned between a locked position and an unlocked position, d) a first coupler mechanism disposed in the housing and configured for selectively enabling force transmission between the handle and the latch device when in an engaged position to move the latch device between the locked and unlocked positions, e) an actuating mechanism disposed within the housing, f) a cam operatively connected to the actuating mechanism, the cam including a lobe, and g) a cam follower assembly including a body rotatably mounted to the housing about an axis, a cam follower operatively engaged with the lobe, and a resilient biasing mechanism operatively engaged with the first coupler mechanism, wherein the actuating mechanism is configured to position the cam so that the lobe engages the cam follower and rotates the body about the axis so that the resilient biasing mechanism places the first coupler mechanism in the engaged position to provide for force transmission between the handle and the latch device.

2. The combination of claim 1 wherein the actuating mechanism includes an electronic motor.

3. The combination of claim 1 wherein the first coupler mechanism includes a clutch plate and a coupler, wherein the coupler is selectively engageable with the clutch plate by the cam lobe, wherein, when engaged, the clutch plate drives the coupler.

4. The combination of claim 1 wherein said resilient biasing member is a leaf spring engageable with the first coupler mechanism.

5. The combination of claim 3 wherein one of the coupler or the clutch plate includes a pin radially displaced outward from a first rotational axis of the one of the coupler or the clutch plate and extending outward in a direction parallel to the first rotational axis, and the other of the coupler or the clutch plate includes a slot extending radially from a second rotational axis of the other of the coupler or the clutch plate and extending in a direction parallel to the second rotational axis, and wherein the pin engages the slot to affect the selective engagement of the clutch plate and the coupler.

6. The combination of claim 1 wherein the handle includes a second coupler mechanism engageable with the first coupler mechanism, wherein the second coupler mechanism includes a shaft fixedly connected to the handle and wherein the shaft is decouplable from the first coupler mechanism.

7. The combination of claim 1 wherein said first coupler mechanism includes a detent, wherein a second coupler mechanism includes a ball and a spring, wherein said ball is biased by said spring and configured for engagement with said detent, and wherein said engagement of said ball with said detent resists relative rotational movement between said first coupler mechanism and said second coupler mechanism.

8. A combination of claim 1, wherein the housing is mountable to a door by a first fastener, the combination comprising:

a cover releasably mounted to the housing by a second fastener, the cover positioned to block access to the first fastener when the cover is mounted to the housing;

a key lock configured for being selectively positioned between a locked position and an unlocked position, wherein the latch device is adapted to lock the door to a door frame when the key lock is in the locked position, and wherein the latch device is adapted to allow the door to be unlocked from the door frame when the key lock is in the unlocked position; and an override bracket operatively connected with the key lock and movable between a first position and a second position, wherein the override bracket is in the first position when the key lock is in the locked position to block access to the second fastener so that the cover is not releasable and access to the first fastener is blocked by the cover, and wherein the override bracket is in the second position when the key lock is in the unlocked position to provide access to the second fastener so that the cover is releasable and the first fastener is accessible.

9. The combination of claim 1, wherein said body of said cam follower assembly includes a first end and a second end, wherein said cam follower is disposed on said first end, wherein said resilient biasing mechanism is disposed on said second end, wherein said cam follower directly engages the lobe, and wherein said resilient biasing mechanism directly engages the first coupler mechanism.

10. A door lock apparatus, comprising in combination:

a) a housing, b) a handle protruding from the housing, c) a latch device disposed within the housing, the latch device configured for being positioned between a locked position and an unlocked position, d) a first coupler mechanism disposed in the housing and configured for selectively enabling force transmission between the handle and the latch device when in an engaged position to move the latch device between the locked and unlocked positions, e) an actuating mechanism disposed within the housing, f) a cam operatively connected to the actuating mechanism, the cam including a lobe and a body portion extending axially from the lobe, wherein the body portion includes a first magnet attached to a surface of the body portion and a second magnet attached to the surface of the body portion and disposed radially away from the first magnet, and wherein the housing includes a Hall Effect sensor aligned with the body portion and configured to sense the rotational position of the cam, and g) a cam follower assembly including a body rotatably mounted to the housing about an axis, a cam follower operatively engaged with the lobe, and a resilient biasing mechanism operatively engaged with the first coupler mechanism, wherein the actuating mechanism is configured to position the cam so that the lobe engages the cam follower and rotates the body about the axis so that the resilient biasing mechanism places the first coupler mechanism in the engaged position to provide for force transmission between the handle and the latch device.

11. A door lock apparatus mountable to a door, the door lock apparatus comprising:

a latch device for selectively locking the door to a door frame;

a housing mountable to the door by a first fastener;

a cover releasably mounted to the housing by a second fastener, the cover positioned to block access to the first fastener when the cover is mounted to the housing;

a key lock configured for being selectively positioned between a locked position and an unlocked position, wherein the latch device is adapted to lock the door to the door frame when the key lock is in the locked position, and wherein the latch device is adapted to allow the door to be unlocked from the door frame when the key lock is in the unlocked position; and an override bracket operatively connected with the key lock and movable between a first position and a second position;

a biasing member mounted to the housing; and a crank cover including a protruding feature extending from the crank cover, wherein the override bracket is in the first position when the key lock is in the locked position to block access to the second fastener so that the cover is not releasable and access to the first fastener is blocked by the cover, wherein the override bracket is in the second position when the key lock is in the unlocked position to provide access to the second fastener so that the cover is releasable and the first fastener is accessible, wherein the biasing member biases the override bracket in a first direction so that the override bracket does not contact the protruding feature when moving from the first position to the second position, and wherein the protruding feature is configured for contacting the override bracket when moving from the first position to the second position when a force is applied to the override bracket in a second direction that is opposite the first direction.

12. A door lock apparatus in accordance with claim 11, further comprising a biasing member mounted to the housing, wherein the biasing member biases the override bracket toward the first position.

13. A door lock apparatus in accordance with claim 11, wherein the key lock includes a key cylinder and a cam, and wherein the cam is configured for moving the override bracket to the second position when the key lock is in the unlocked position.

14. A door lock apparatus in accordance with claim 11, wherein an aperture is defined in the housing, and wherein the second fastener is accessible through the aperture when the override bracket is in the second position.

15. A door lock apparatus in accordance with claim 11, wherein the cover is a battery cover.

* * * * *